US005769565A

United States Patent [19]

Martin, Jr. et al.

[11] Patent Number: 5,769,565

[45] Date of Patent: Jun. 23, 1998

[54] PROTECTIVE HOUSING FOR SEWER OR SEPTIC CLEAN-OUT LINES

[75] Inventors: Thomas J. Martin, Jr.; Glenn Martin, both of Kearny, N.J.

[73] Assignee: C.P. Test Services-Valvco, Inc., Kearny, N.J.

[21] Appl. No.: 699,508

[22] Filed: Aug. 19, 1996

[51] Int. Cl.[6] ..... E02D 29/14

[52] U.S. Cl. ..... 404/25; 52/20; 137/370; 137/371

[58] Field of Search ..... 52/19, 20; 137/370, 137/371; 404/25, 26

[56] References Cited

U.S. PATENT DOCUMENTS 4,350,177 9/1982 Firchau et al. ..... 137/370

5,063,996 11/1991 Kenner ..... 404/25 X 5,402,848 4/1995 Kelly ..... 52/20 X 5,525,006 6/1996 Kilman et al. ..... 404/25

*Primary Examiner*—James Lisehora

*Attorney, Agent, or Firm*—Clifford G. Frayne

[57] ABSTRACT

A protective cover for sewer clean-out lines for protection of the termination end of the sewer clean-out line, but permitting access to the sewer clean-out line, the housing having a cast iron collar with removable cover made into an ABS plastic skirt by force fitting, the plastic skirt having a flared lower end to maintain the position of the housing with the upper surface and cover of the cast iron collar being flush with the level of the ground.

9 Claims, 2 Drawing Sheets

PROTECTIVE HOUSING FOR SEWER OR SEPTIC CLEAN-OUT LINES

BACKGROUND OF THE INVENTION

1. Field of the Invention

The present invention relates to protective housings, and in particular, for a protective housing for a sewer clean-out line or septic line either public or private which allows access to the sewer or septic line for removal of blockages and the like.

2. Description of the Prior Art

The art which appears to be most analogous to the invention of Applicant appears to be with respect to roadway boxes and curb boxes which provide protective casings for underground utility lines wherein the protective casing allows access to a valve in the selected utility line which may be buried several feet below the ground. These roadway or curb boxes are most often found along the streets and are normally positioned between the curb and the sidewalk. In most instances, they will have a cast iron cover which is lockable in position by the utility to prevent vandalism, but which is removable in order to allow the utility to gain access to the underground valve by means of an extension wrench slidably positioned into the opened casing and engageable with the underground valve. The art in this area includes not only Applicant's prior patents, but also U.S. Pat. No. 2,094,523 to Bugby; U.S. Pat. No. 794,661 to Clark; U.S. Pat. No. 1,014,138 to Ford; U.S. Pat. No. 1,710,571 to Forni; U.S. Pat. No. 5,054,956 to Huang and U.S. Pat. No. 4,030,519 to Zinn.

Most of the aforesaid curb boxes or roadway boxes are designed to allow access to a valve which is positioned in a utility line several feet below the surface of the earth. The current invention is designed to protect and simultaneously provide access to a sewer clean-out line which typically extends above and terminates above the surface of the ground, the sewer clean-out line extending downwardly beneath the surface of the earth to an underground sewer line located several feet below the surface of the earth.

The purpose of the sewer clean-out line is to allow access to the main line to remove obstacles and obstructions which may arise during the course of the use of the sewer line.

In typical residential construction, the sewer clean-out line is designed to extend above the surface of the ground having a screw-on locking cap to prevent the ingress of matter which would plug the sewer and also to prevent the egress of sewer gases and the like. Because it extends above the ground, the terminating end of the sewer clean-out line is often subject to vandalism, and/or damage from natural conditions or accidents. Further, the extension of the sewer clean-out line above the surface of the ground in many instances provides an unaesthetic appearance to the dwelling, since in most instances, the sewer lines from a dwelling would run beneath the front of the house towards the street where the main intercepting sewers would be located. This would thus cause the sewer clean-out line to protrude above the surface of the earth somewhere in the front of the dwelling unit thus detracting from the appearance unless disguised, camouflaged or hidden by bushes.

It has been the desire of contractors to be able to locate the termination point of the sewer clean-out line below the surface of the earth, but still protect sewer clean-out line termination point from the accumulation of dirt and other debris about it, such that no excavation would be necessary to reach the sewer clean-out line, open it and permit the use of specialized clean-out equipment to remove the obstructions in the sewer line. Furthermore, it is a matter of good public policy that sewer cleanouts be installed and subsequently maintained. State and local governments have made substantial investments in sewer infrastructure and sewer cleanout caps protect that investment and, therefore, the protection of the sewer cleanout cap is in keeping with this goal.

Attempts have been made to provide such a casing and one such example will be described by Applicant in the specification with relationship to the prior art.

Applicant believes that it has developed a superior protective cover for sewer clean-out lines which is not only lighter in weight, less costly, but also ensures superior protection to the termination point of the sewer clean-out line and greatly improves the aesthetic appearance associated with such clean-out lines. In addition, Applicant's protective cover meets the loading requirements of the U.S. Department of Transportation should it be positioned where it would be subject to vehicular traffic.

OBJECTS OF THE INVENTION

An object of the present invention is to provide for a novel protective cover for sewer clean-out lines which provides for a more aesthetic appearance and allows the termination point of the sewer clean-out line to be positioned beneath the surface of the earth.

A still further object of the present invention is to provide for a novel protective cover for a sewer clean-out line which maintains the termination point of the sewer clean-out line within an easy access casing with no debris positioned thereabout thus requiring excavation to gain access to the protective cover for the sewer clean-out line.

A still further object of the present invention is to provide for a novel protective cover for a sewer clean-out line which is self leveling and which will not sink beneath the surface of the earth, thus preventing access to the sewer clean-out line.

A still further object of the present invention is to provide for a novel protective cover for a sewer clean-out line which may be assembled in the field and which greatly reduces the weight associated with such a protective cover for sewer clean-out lines.

SUMMARY OF THE INVENTION

A protective cover for sewer clean-out lines, the protective cover having a collar and cover dimensioned so as to permit access to the termination point of a sewer clean-out line, the collar having a depending cylindrical skirt having a divergent taper from the collar downwardly, a second member comprised of ABS plastic or the like, being generally cylindrical in nature, and flared at its lower end, and engageable in the cylindrical depending skirt of the collar and friction fit within by means of an annular indent in the cylindrical skirt positioned beneath protruding stops in the cylindrical skirt.

BRIEF DESCRIPTION OF THE DRAWINGS

These and other objects of the presents invention will become evident, particularly when taken in light of the following illustration wherein.

DETAILED DESCRIPTION OF THE DRAWINGS

Figure 1:
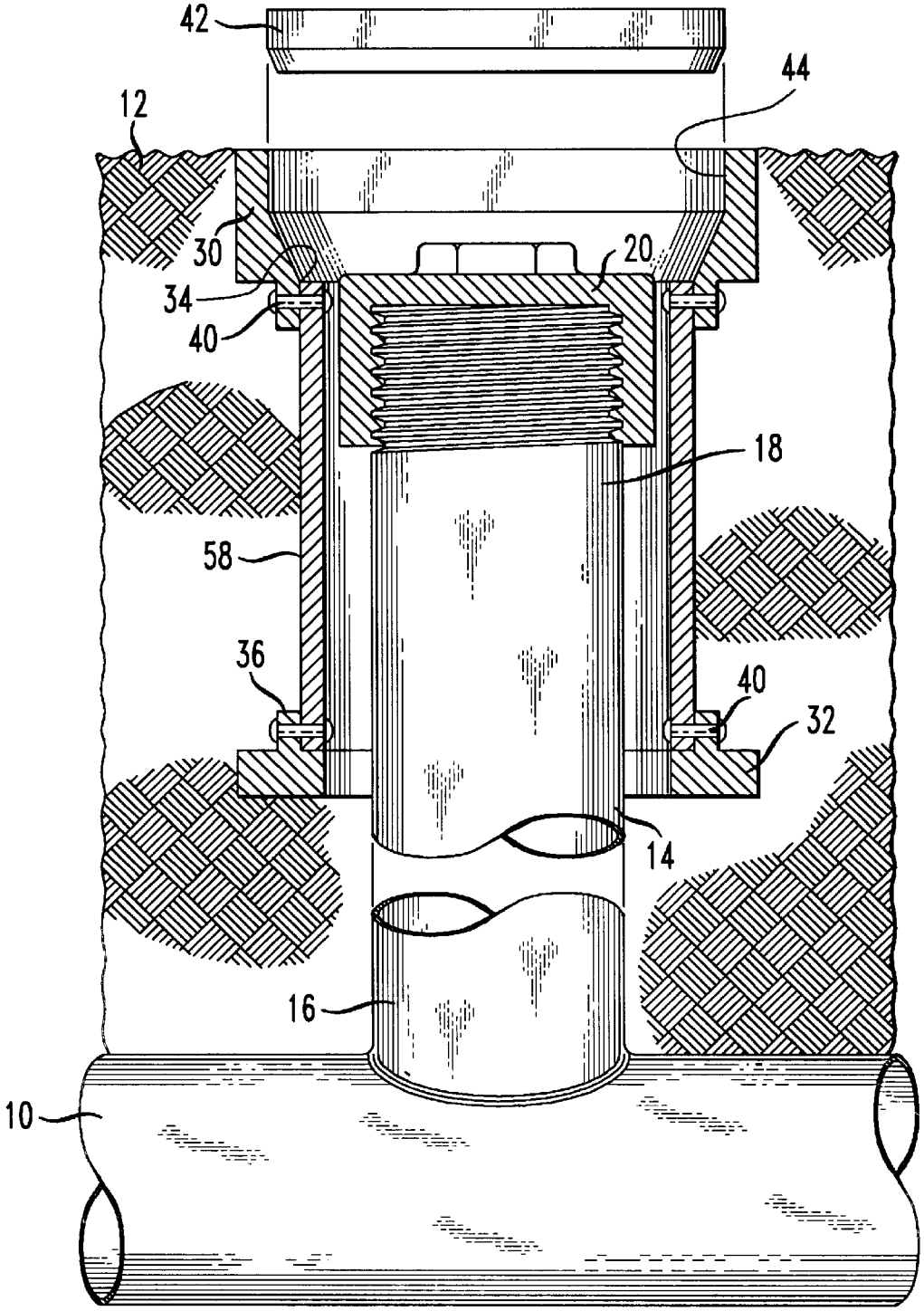
FIG. 1 (PRIOR ART)
FIG. 1 is a side elevational side partial cutaway view of the prior art in conjunction with a sewer clean-out line.

FIG. 1 is illustrative of the relationship between a sewer clean-out line and the actual sewer and FIG. 1 also illustrates by means of a cross-sectional, side elevational view, the present state of the prior art utilized to protect the terminal end of the sewer clean-out line.

In a typical construction, a sewer line 10 runs from a dwelling unit or building to a street or interceptor sewer. Sewage typically travels under gravitational flow in such a situation and the sewer line 10 is normally positioned several feet below the surface of the earth 12. The sewer line 10 would normally have a sewer clean-out line 14 positioned along its length between the building and the interceptor or street sewer. The sewer clean-out line 14 allows access to the sewer line 10 in order to insert cleaning apparatus to remove blockages, plugs or vegetation roots which have invaded the sewer line 10. Clean-out line 14 would intersect sewer line 14 at either end angled or T-intercept 16. In past practice, upper end 18 of clean-out line 14 would extend above the surface of the earth 12 and have a removably securable cap 20 affixed thereto. As stated previously, it has become the desire to protect the upper end 18 of sewer clean-out line 14 by having this terminal end positioned below the surface of the earth 12 so as to prevent vandalism or accidents which would damage the closure 20 and thus release sewer gases or allow the ingress of material which could deleteriously affect sewer line 10.

As illustrated in FIG. 1, the upper end 18 of clean-out line 14 is now positioned below the surface 12 of the earth and is illustrated as being protected by a protective covering which constitutes the state of the prior art with respect to sewer clean-out line protective devices.

The present sewer clean-out protective device comprises an upper circular collar 30 normally composed of cast or wrought iron and a lower cast iron collar 32 normally made of the same materials. Upper collar 30 and lower collar 32 each have a cylindrical opening 34 and 36, respectively, which is greater than the diameter of sewer clean-out line 14. Upper collar 30 and lower collar 32 are secured together by means of a cylindrical member 38 which is secured by a plurality of fastening means 40 to upper collar 30 and lower collar 32. In the instant embodiment, it can be seen that upper collar 30 and lower collar 32 each have a circumferential flange which accepts the fastening means 40 which in turn engage the cylindrical member 38. In many instances, cylindrical member 38 is also comprised of cast or wrought iron and in some instances, it can be manufactured from plastic material, such as ABS or the like. Nevertheless, despite the choice of materials, the normal practice is to use a plurality of fastening means 40, such as rivets or the like, to secure cylindrical member 38 to upper collar 30 and lower collar 32. Upper collar 32 is designed for receipt of a closure means 42 in the form of a locking cap which would secure opening 44 in the upper end of upper collar 30 and such is to prevent access to the sewer clean-out line and its closure means 20 without the proper tool for removal of the cap.

The present practice is to excavate for the sewer line and the sewer clean-out line 10 and 14, respectively, position the sewer line and sewer clean-out line and then backfill to a point where the upper end 18 of sewer clean-out line 14 would be positioned below the surface of the earth. Before the complete backfill procedure was completed, the combination of upper collar 30, lower collar 32 and cylindrical member 38 would be fabricated and secured together and then positioned about sewer clean-out line 14, such that lower collar 32 would rest on backfilled earth at such a height that upper collar 30 and cap 42 would be flush with the surface of the earth 12. The backfill operation would then be completed with the earth being backfilled about the exterior of the protective housing. Cap 42 would then be secured and the sewer clean-out line would not be visible, yet would still be easily accessible for its intended use.

The drawbacks with the prior art as it presently exists is the fabrication process in order to secure upper collar 30 with lower collar 32 and cylindrical member 38 by means of a plurality of fastening means 40. Secondly, the weight of the prior art solution increases its cost along with the fabrication time. Finally, because of its weight and design, the present protective housings have a tendency to settle due to their weight and subsequently be covered up by soil, such that they are no longer easily located when needed. Applicant's invention addresses each of these problems and provides for a lighter weight protective housing requiring less fabrication time and no fastening means and which utilizes the actual backfill of the earth to maintain it in position with respect to settling.

Figure 2:
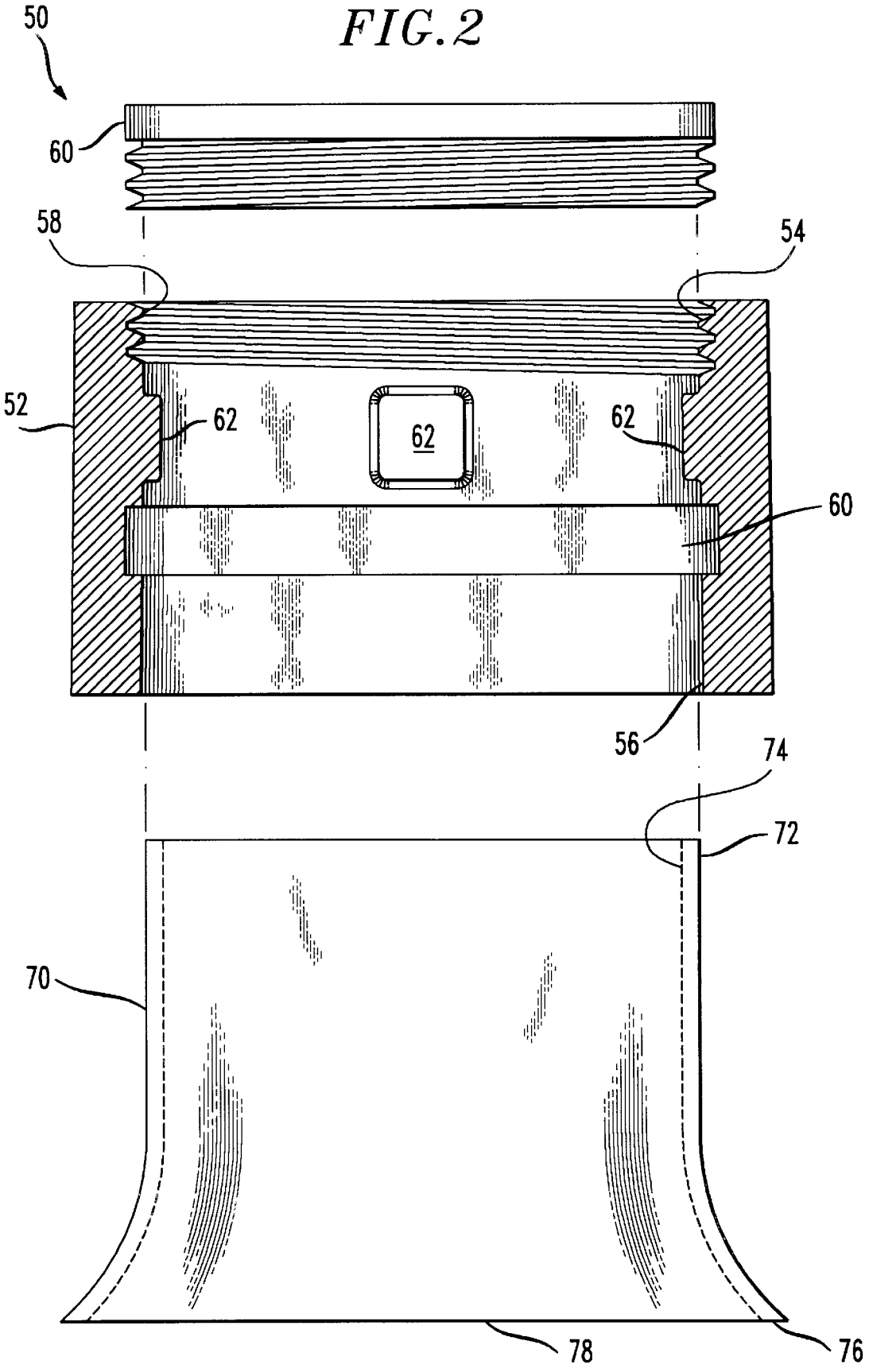
FIG. 2 is a side elevational exploded view of the protective housing of Applicant's invention.

FIG. 2 is an exploded view of Applicant's protective housing for a sewer clean-out line designated generally as 50. Applicant's protective housing 50 comprises three components. The first component is a collar 52 generally cylindrical in nature defining a throughbore 54 having a lower opening 56 and an upper opening 58, upper opening 58 designed to receive and removably secure a cap 60 which is the second element of Applicant's protective housing 50. Disposed about throughbore 54 is an annular recess 60 which in a preferred embodiment would range from ½ to ¾ of an inch in width and approximately ⅛ of an inch in depth into the inner sidewall of collar 52. Disposed on the inner sidewall of throughbore 54 are a plurality of protrusions 62 which are disposed about the inner sidewall of throughbore 54 slightly above annular indent 60. Protrusions 62 serve as stops as will be more fully discussed hereafter.

In addition to the above, throughbore 54 is slightly tapered in a divergent manner from upper opening 58 to lower opening 56, such that the diameter of lower opening 56 is slightly greater than the diameter of upper opening 58. In the preferred embodiment, this difference is approximately 1/16 of an inch.

The third element of Applicant's protective housing assembly 50 is skirt 70. While collar 52 and cap 60 are preferably made from cast iron or wrought iron, skirt 70 is constructed of relatively rigid plastic material, such as ABS or the like. Skirt 70 is generally cylindrical in nature having an upper end 72 having an opening 74 and a lower end 76 having an opening 78. Lower end 76 is annularly flared such that its diameter is greater than the diameter of upper end 72.

The diameter of upper end 72 of skirt member 70 is equal to the diameter of the throughbore 54 at lower end 56 of skirt 52. In fabricating the protective housing 50, the upper end 72 of skirt 70 is coated with a lubricant, such as methyl ethyl ketone and upper end 72 is then inserted into throughbore 54 at lower end 56 of collar 52 and pushed or twisted upwardly until the upper end 72 of skirt 70 comes into contact with protrusions or stops 62, thus terminating the insertive movement of skirt 70 into collar 52. Since the diameter of upper end 72 of skirt 70 is equal to the diameter of throughbore 54 at lower end 56 of collar 52, and since the diameter of throughbore 54 diminishes in the direction of upper end 58, the upper end 72 of skirt 70 is somewhat deformed as it progresses during this insertive step, such that when the upper end 72 contacts protrusions or stops 62, the upper end portion 72 of skirt 70 has been deformed such that it expands to fill the space formed by annular indent 60. Skirt member 70 sets in this position and collar 52 and skirt 70 are affirmly secured to each other without the need for any additional fastening means as required by the prior art.

The lower flared portion 76 of skirt 70 is formed during the molding process and serves to cooperate with the soil and earth deposited about the sewer clean-out line 14 during the backfill process, such that Applicant's protective housing assembly 50 can be positioned to ensure that cap 60 and upper end 58 of collar 52 are flush with the ground and will not settle or sink due to the cooperation of lower flared end 76 of skirt 70.

While the present invention has been described in connection with the exemplary embodiments thereof, it will be understood that many modifications will be apparent to those of ordinary skill in the art and the application is intended to cover any adaptations or variations thereof. Therefore, it is manifestly intended that this invention be only limited by the claims and the equivalents thereof.

What is claimed:

1. A protective housing for sewer clean-out or septic cleanout covers comprising:

a sewer clean-out line connected to the sewer line, said clean-out line extending upwardly and terminating with a removable cap, proximate to the ground surface;

a protective housing for the upper portion of said sewer clean-out line and said cap, said protective housing comprising a collar having an inner diameter and an outer diameter defining a generally planar upper surface, said inner diameter greater than the diameter of said upper portion and said cap of said sewer clean-out line to receive same, said collar having a first depending tubular skirt of depending increasing interior diameter there being formed on the interior circumference of said skirt, an annular circumferential recess having a plurality of protrusion stops formed on said interior circumference above said annular recess;

a second tubular skirt having an upper end, the outer dimension which is greater than the inner diameter of said collar, said second tubular skirt depending in tubular shape from said upper end and terminating in a lower end being flared to a diameter greater than said upper end;

a cap lockingly engageable with said collar.

2. The protective housing of claim 1 wherein said second tubular skirt is force fit into said depending tubular skirt of said collar for engagement with said protrusion stops.

3. The protective housing in accordance with claim 1 wherein the upper end of said second tubular skirt is lubricated and expands to engage said annular recess of said tubular skirt of said collar.

4. The protective housing in accordance with claim 1 wherein said collar is comprised of cast iron.

5. The protective housing in accordance with claim 1 wherein the second tubular skirt of said protective housing is formed of ABS material.

6. A collar member for engagement with a tubular member of dissimilar material for closure of said tubular member, said collar member having an inner diameter and an outer diameter defining a generally planar upper surface, a depending tubular skirt of increasing interior diameter, there being formed on the interior circumference of said skirt an annular circumferential recess having a plurality of protrusion stops formed on said interior circumference above said annular recess, said depending tubular skirt for receipt of said tubular member of a diameter equal to the increased diameter of said tubular skirt of said collar, said tubular member being force fit into said tubular skirt for engagement with said protrusion stops and expansion into said annular recess on said interior circumference of said tubular skirt of said collar, said collar having a closure means removably securable to said planar upper surface.

7. The collar member in accordance with claim 6 wherein said collar member is composed of cast iron.

8. The collar member in accordance with claim 6 wherein said tubular member is composed of ABS material.

9. A method for manufacturing a protective housing for a sewer clean-out or septic clean-out cover comprising:

forming a collar, said collar having an inner diameter and an outer diameter defining a generally planar upper surface;

forming a depending tubular skirt on said collar, said tubular skirt having a depending, increasing, interior diameter;

forming an annular circumferential recess on the inner circumference of said depending tubular skirt;

forming a plurality of protrusion stops depending outwardly from said interior circumference of said depending tubular skirt and positioned above said annular recess;

forming a second tubular skirt having an upper end, and an outer dimension which is equal to the increased interior diameter of said depending tubular skirt of said collar, said second tubular skirt having an opposing end flared to a greater diameter than said upper end;

lubricating the upper end of said second tubular skirt;

force fitting said upper end of said second tubular skirt into said depending tubular skirt of said collar causing said upper end of said second tubular skirt to engage said plurality of protrusion stops formed on said interior circumference of said collar above said annular recess and to expand into said annular recess.

* * * * *